US008647799B2

(12) United States Patent
Itou et al.

(10) Patent No.: US 8,647,799 B2
(45) Date of Patent: Feb. 11, 2014

(54) ERASABLE TONER AND METHOD FOR PRODUCING THE SAME

(75) Inventors: Tsuyoshi Itou, Shizuoka-ken (JP); Takayasu Aoki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 296 days.

(21) Appl. No.: 12/953,737

(22) Filed: Nov. 24, 2010

(65) Prior Publication Data

US 2011/0165507 A1 Jul. 7, 2011

Related U.S. Application Data

(60) Provisional application No. 61/292,049, filed on Jan. 4, 2010.

(51) Int. Cl.
*G03G 9/09* (2006.01)

(52) U.S. Cl.
USPC ..... 430/108.2; 430/110.1

(58) Field of Classification Search
USPC ..... 430/108.2, 110.1
See application file for complete search history.

(56) References Cited

U.S. PATENT DOCUMENTS 6,203,603 B1 * 3/2001 Takayama et al. ..... 106/31.16
2009/0087767 A1 4/2009 Nakamura

FOREIGN PATENT DOCUMENTS

EP 1 041 448 A1 10/2000
EP 2 219 081 A2 8/2010
JP 06027729 A 2/1994

* cited by examiner

*Primary Examiner* — Hoa V Le
(74) *Attorney, Agent, or Firm* — Turocy & Watson, LLP

(57) ABSTRACT

An erasable toner is prepared by mixing colored particles containing at least a color former compound, a color developer agent and a binder resin with de-coloring particles having a melting point higher than the fixing temperature of the colored particles. By using this toner, a colored image is formed by electrostatically transferring a toner image onto a medium, and heating the toner image at a temperature lower than the melting point of the de-coloring particles to form a fixed toner image in a color developed state, and the color of the fixed image is erased by heating the image to a temperature not lower than the melting point of the de-coloring particles. In this toner, the color developing function and the color erasing function are assigned to different particles so that the functions are separated from each other, and therefore, the formation of an image in a color developed state and the erasure thereof can be reliably and promptly achieved.

5 Claims, 2 Drawing Sheets

ERASABLE TONER AND METHOD FOR PRODUCING THE SAME

CROSS-REFERENCE TO RELATED APPLICATION

This application is based upon and claims the benefit of priority from: U.S. provisional application 61/292,049, filed on Jan. 4, 2010, the entire contents of which are incorporated herein by reference.

FIELD

Embodiments described herein relate generally to an erasable electrophotographic toner. A technique for recycling a recording medium such as paper by erasing the color of a toner image formed on the recording medium such as paper is very effective from the viewpoint of environmental protection and economic efficiency due to reduction in consumption of a recording medium such as paper.

BACKGROUND

Like an electrophotographic toner containing a color former compound proposed in JP-B-3457538, etc., a toner having an achromatism is known. Such a toner can be produced through a so-called kneading and pulverization process. In the process, a toner is obtained by melt-kneading a color former compound, a color developer agent, a de-coloring agent, a binder resin, etc., thereby dispersing the color former compound, the color developer agent, and the de-coloring agent in the binder resin, and finely pulverizing the resulting solid to about several μm. This toner is in the form of a powder and is in a colored state (color-developed state), and the colored state is maintained even after the toner is transferred onto paper and fixed thereon by heating. For the erasure, the paper is fed to an erasing device and heated therein, thereby erasing the image. However, in this method, a color former compound, a color developer agent and a de-coloring agent are melt-kneaded at the same time, and therefore, this method has a disadvantage that if a de-coloring agent which is basic and has a strong de-coloring (or achromatizing) action is used, the developed color density is decreased or the color is lost. Meanwhile, if a de-coloring agent having a weak color achromatizing action is used for increasing the developed color density, the erasing speed becomes low, and therefore, it is necessary to perform heating for along time for erasing.

DETAILED DESCRIPTION

Figure 1:
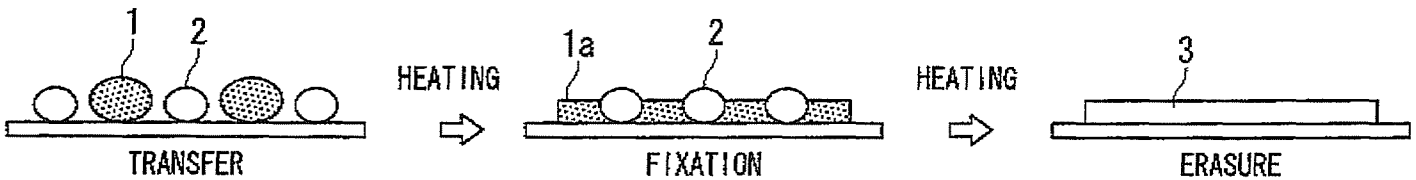
FIG. 1 is a schematic view illustrating color developing and erasing processes using a toner containing de-coloring particles with a size on the order of microns.

The invention improves the above-mentioned problems and can provide an erasable toner having excellent color developing and erasing properties.

According to an embodiment of the invention, a toner comprises a particle mixture (or blend) of colored particles containing at least a color former compound, a color developer agent and a binder resin with de-coloring particles having a melting point higher than the fixing temperature of the colored particles.

Further, the toner is obtained by mixing (or blending) colored particles containing at least a color former compound, a color developer agent and a binder resin, with de-coloring particles having a melting point higher than the fixing temperature of the colored particles, to form a particle mixture. The particle diameter of the colored particles is generally on the order of microns, and if the particle diameter of the de-coloring particles is on the order of microns, an ordinary particle mixture of colored particles and de-coloring particles is obtained by mixing them. If the particle diameter of the de-coloring particles is on the order of sub-microns, a particle mixture in a so-called externally added and mixed state where the de-coloring particles adhere to the surfaces of the colored particles due to an electrostatic adsorption force is obtained by mixing them.

The characteristic of the above toner is that the color developing function and the color erasing function are completely separated from each other. In the fixing temperature range, only the colored particles are melted and fixed. At this time, the de-coloring particles are not melted, and therefore do not affect the color development mechanism. Accordingly, the developed color state is maintained. On the other hand, in the erasing temperature range, the colored particles and the de-coloring particles are both melted, and therefore, the de-coloring particles are melt-mixed with the colored particles and the color of the color developed portion is achromatized, and therefore, the color erased state is formed and maintained.

Hereinafter, preferred embodiments of the invention will be sequentially described. In the following description, "%" and "part(s)" expressing compositions are by weight unless otherwise stated.

The colored particles contain at least a color former compound, a color developer agent and a binder resin. The color former compound and the color developer agent are required for controlling the color development and erasure mechanism. A release agent, a charge control agent, etc., may be added thereto as needed. As the process for producing the particles, a conventional process can be used, and the particles can be prepared by a kneading and pulverization process. If necessary, the particles can also be prepared by a wet production process such as a suspension polymerization process, an emulsion aggregation process, or a dissolution suspension process.

Representative examples of the color former compound include a leuco dye. The leuco dye is an electron donating compound capable of developing a color by the action of a color developer agent. Examples thereof include diphenylmethane phthalides, phenyl-indolyl phthalides, indolyl phthalides, diphenylmethane azaphthalides, phenylindolyl azaphthalides, fluorans, styrynoquinolines, and diazarhodamine lactones.

Specific examples of the color former compound include: 3,3-bis(p-dimethylaminophenyl)-6-dimethylamino-phthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexyl-aminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)-fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H) isobenzofuran]-3'-one, 2-(diethylamino)-8-(diethylamino)-4-methyl-, spiro[5H-(1)benzopyrano-(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d) pyrimidine-5,1'(3'H)-isobenzofuran]-3'-one, 2-(di-n-butylamino)-8-(diethylamino)-4-methyl-, spiro[5H-(1) benzo-, pyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano-(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl'2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used by mixing two or more of them.

The concentration of the color former compound in the colored particles is preferably from 0.5 to 20%, particularly preferably from 1 to 10%. If it is less than 0.5%, the developed color density is low, and if it exceeds 20%, it becomes difficult to achieve a complete achromaticity.

The color developer agent to be used in the invention is an electron-accepting compound which donates a proton to the leuco dye. Examples thereof include: phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof. Additional examples thereof include those having, as a substituent, an alkyl group, an aryl group, an acyl group, an alkoxycarbonyl group, a carboxy group or an ester thereof, an amide group, a halogen group, etc., and bisphenols, trisphenols, phenol-aldehyde condensed resins, and metal salts thereof. These compounds can be used by mixing two or more species.

Specific examples thereof include: phenol, o-cresol, tertiary butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid, or esters thereof such as 2,3-dihydroxybenzoate and methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxy-diphenylsulfone, 1,1-bis(4-hydroxyphenyl)ethane, 2,2-bis(4-hydroxy-3-methylphenyl)propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)-n-hexane, 1,1-bis(4-hydroxyphenyl)-n-heptane, 1,1-bis(4-hydroxyphenyl)-n-octane, 1,1-bis(4-hydroxyphenyl)-n-nonane, 1,1-bis(4-hydroxyphenyl)-n-decane, 1,1-bis(4-hydroxyphenyl)-n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl) hexafluoropropane, 2,2-bis(4-hydroxyphenyl)-n-heptane 2,2-bis(4-hydroxyphenyl)-n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxy-phenyl)methyl]-1,2,3-benzenetriol, 4,6-bis[(3,5-dimethyl-4-hydroxyphenyl) methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4, 4 (1-methylethylidene)-bisphenol, and methylenetris-p-cresol.

The color developer agent is used in an amount of preferably from 0.5 to 10 parts, particularly preferably from 1 to 5 parts per one part of the color former compound. If it is less than 0.5 part, the developed color density becomes low, and if it exceeds 10 parts, it becomes difficult to achieve a complete achromaticity.

Examples of the binder resin include: styrene resins such as polystyrene, styrene-butadiene copolymers, and styrene-acrylic copolymers; ethylene resins such as polyethylene, polyethylene-vinyl acetate copolymers, polyethylene-norbornene copolymers, and polyethylene-vinyl alcohol copolymers; polyester resins, acrylic resins, phenol resins, epoxy resins, allyl phthalate resins, polyamide resins, and maleic acid resins. These resins may be used alone or in combination of two or more of them. When such resins are polymerized, the above-mentioned polymerizable monomer, a chain transfer agent, a crosslinking agent, a polymerization initiator, etc. can be used. Further, these binder resins preferably have a glass transition temperature of from 40 to 80° C. and a softening point of from 80 to 180° C., and provide a fixing temperature of generally from 50 to 200° C., preferably from 50 to 150° C., by itself or together with a release agent as described to be used in combination as needed. As the binder resin, a polyester resin which has a favorable fixability is particularly desirable. Further, the polyester resin preferably has an acid value of 1 mgKOH/g or more. With the use of the polyester resin having such en acid value, an alkaline pH adjusting effect is exhibited during pulverization, and colored particles having a small particle diameter can be obtained.

Examples of the release agent include: aliphatic hydrocarbon waxes such as low molecular weight polyethylene, low molecular weight polypropylenes, polyolefin copolymers, polyolefin wax, microcrystalline wax, paraffin wax, and Fischer-Tropsch wax; oxides of aliphatic hydrocarbon waxes such as oxidized polyethylene waxes and block copolymers thereof; vegetable waxes such as candelilla wax, carnauba wax, Japan wax, jojoba wax, and rice wax; animal waxes such as bees wax, lanolin, and whale wax; mineral waxes such as ozokerite, ceresin, and petrolatum; waxes containing a fatty acid ester as a main component such as montanic acid ester wax, and castor wax; and materials obtained by deoxidization of a part or the whole of a fatty acid ester such as deoxidized carnauba wax. Further, saturated linear fatty acids such as palmitic acid, stearic acid, montanic acid, and long chain alkyl carboxylic acids having a long chain alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and long chain alkyl alcohols having a long chain alkyl group; polyhydric alcohols such as sorbitol; fatty acid amides such as linoleic acid amide, oleic acid amide, and lauric acid amide; saturated fatty acid bisamides such as methylenebis stearic acid amide, ethylenebis caprylic acid amide, ethylenebis lauric acid amide, and hexamethylenebis stearic acid amide; unsaturated fatty acid amides such as ethylenebis oleic acid amide, hexamethylenebis oleic acid amide, N,N'-dioleyladipic acid amide, and N,N'-dioleylsebacic acid amide; aromatic bisamides such as m-xylenebisstearic acid amide and N,N'-distearyl-isophthalic acid amide; fatty acid metal salts (generally called metal soaps) such as calcium stearate, calcium laurate, zinc stearate, and magnesium stearate; waxes obtained by grafting of a vinyl monomer such as styrene or acrylic acid on an aliphatic hydrocarbon wax; partially esterified products of a fatty acid and a polyhydric alcohol such as behenic acid monoglyceride; and methyl ester compounds having a hydroxyl group obtained by hydrogenation of a vegetable fat or oil can be exemplified.

As the charge control agent, for example, a metal-containing azo compound is used, and the metal element is desirably a complex or a complex salt of iron, cobalt or chromium or a mixture thereof. Other than these, a metal-containing salicylic acid derivative compound can also be used, and the metal element is desirably a complex or a complex salt of zirconium, zinc, chromium, or boron, or a mixture thereof.

The colored particles are preferably prepared as a granulated mixture containing the above-mentioned color former compound, color developer agent and binder resin, and a component to be added as needed, such as a release agent or a charge control agent, in the form of particles having a 50%-volume average particle diameter of from 3 to 20 μm, particularly preferably from 4 to 10 μm. The thus—formed colored particles are generally in an already colored state due to the co-presence and reaction with each other of the color former compound and the color developer agent.

Further, a charge adjusting agent, an external additive, etc., can be added as needed. For example, inorganic fine particles having a size on the order of sub-microns can be added and mixed into the surfaces of the colored particles in an amount of from 0.01 to 20 wt % based on the total weight of the colored particles for adjusting the fluidity or chargeability of the colored particles. As such inorganic fine particles, silica, titania, alumina, strontium titanate, tin oxide, etc., can be used alone or by mixing two or more species thereof. It is preferred that as the inorganic fine particles, those surface-treated with a hydrophobizing agent are used from the viewpoint of improvement of environmental stability. Further, other than such inorganic oxides, resin fine particles having a particle diameter of 1 μm or less may be externally added for improving the cleaning property.

On the other hand, the de-coloring particles may be particles comprising a de-coloring agent alone or comprising an additive such as a release agent or a charge control agent in addition to a de-coloring agent. In accordance with this, the de-coloring agent is selected so that the de-coloring particles have a melting point (color erasing temperature) of from about 60 to 250° C., which is higher than the fixing temperature of the colored particles by 10 to 50° C. by itself or in combination with an additional component such as a release agent. As the process for producing the particles, the same production process as that for the colored particles can be used, however, the particle diameter is preferably reduced to the order of sub-microns by wet-pulverization, etc.

As the de-coloring agent to be used in the de-coloring particles of the invention, a known compound can be used as long as it can inhibit the color development reaction between the leuco dye and the color developer agent so as to change the developed color to achromaticity at a color erasing temperature in a three-component system containing a color former compound, a color developer agent, and a de-coloring agent.

Examples of the de-coloring agent include: aliphatic higher alcohols, polyethylene glycol, nonionic surfactants, cationic surfactants, and hindered amine derivatives.

Examples of the hindered amine derivative include: tetrakis(1,2,2,6,6-pentamethyl-4-piperidyl)-1,2,3,4-butanetetracarboxylate, tetrakis(2,2,6,6-tetramethyl-4-piperidyl)-butane-1,2,3,4-butanetetracarboxylate, a condensate of 1,2,3,4-butanetetracarboxylic acid with 1,2,2,6,6-pentamethyl-4-piperidinol and β,β,β,β-tetramethyl-3,9-(2,4,6,8,10-tetraoxaspiro[5,5]undecane)diethanol, and bis(2,2,6,6-tetramethyl-4-piperidyl)sebacate. Further, commercially available products of the hindered amine derivative include: CHIMASSORB 2020 FDL, CHIMASSORB 944 FDL, TINUVIN 622 LD TINUVIN 144, TINUVIN 765, TINUVIN 770 DF, TINUVIN 111 FDL, TINUVIN 783 FDL, and TINUVIN 791 FB, all of which are manufactured by Ciba Specialty Chemicals Inc., ADECASTAB LA-52, ADECASTAB LA-57, ADECASTAB LA-63P, ADECASTAB LA-77Y, ADECASTAB LA-68LD, ADECASTAB LA-77G, ADECASTAB LA-402XP, ADECASTAB LA-502XP, and ADECA ACRUSE DN-44M, all of which are manufactured by Asahi Denka Kogyo K.K., etc. can be exemplified.

Examples of the nonionic surfactant include polyoxyethylene alkyl ethers, polyoxyalkylene alkyl ethers, polyoxyethylene derivatives, sorbitan fatty acid esters, polyoxyethylene sorbitan fatty acid esters, polyoxyethylene sorbitol fatty acid esters, glycerin fatty acid esters, polyoxyethylene fatty acid esters, polyoxyethylene hydrogenated castor oil, polyoxyethylene alkyl amines, and alkyl alkanol amides.

Examples of the cationic surfactant include: alkyl amine salts and alkyl quaternary ammonium salts.

Examples of the aliphatic higher alcohol include: lauryl alcohol, stearyl alcohol, myristyl alcohol, and cetyl alcohol.

Further, the de-coloring agents known in JP-A-2000-19770, etc., can also be used. Examples thereof include cholesterol, stigmasterol, pregnenolone, methylandrostenediol, estradiol benzoate, epiandrostene, stenolone, β-sitosterol, pregnenolone acetate, β-chorestarol, 5,16-pregnadiene-3β-ol-20-one, 5α-pregnen-3β-ol-20-one, 5-pregnen-3β, 17-diol-20-one-21-acetate, 5-pregnen-3β, 17-diol-20-one-17-acetate, 5-pregnen-3β, 21-diol-20-one-21-acetate, 5-pregnen-3β, 17-diol diacetate, rockogenin, thigogenin, esmiragenin, heckogenin, diosgenin, cholic acid, methyl cholate, sodium cholate, lithocholic acid, methyl lithocholate, sodium lithocholate, hydroxycholic acid, methyl hydroxycholate, hyodeoxycholic acid, methyl hyodeoxycholate, testosterone, methyltestosterone, 11α-hydroxymethyltestosterone, hydrocortisone, cholesterol methyl carbonate, α-cholestanol, D-glucose, D-mannose, D-galactose, D-fructose, L-sorbose, L-rhamnose, L-fucose, D-ribodesose, α-D-glucose pentaacetate, acetoglucose, diacetone-D-glucose, D-glucuronic acid, D-galacturonic acid, D-glucosamine, D-fructosamine, D-isosaccharic acid, vitamin C, erutorubic acid, trehalose, saccharose, maltose, cellobiose, gentiobiose, lactose, melibiose, raffinose, gentianose, melezitose, stachyose, methyl α-glucopyranoside, salicin, amygdalin, euxanthic acid, cyclododecanol, hexahydrosalicylic acid, menthol, isomenthol, neomenthol, neoisomenthol, carbomenthol, α-carbomenthol, piperithol, α-terpineol, β-terpineol, γ-terpineol, 1-p-menthene-4-ol, isopulegol, dihydrocarveol, carveol, 1,4-cyclohexanediol, 1,2-cyclohexanediol, phloroglucitol, quercitol, inositol, 1,2-cyclododecanediol, quinic acid, 1,4-terpene, 1,8-terpene, pinol hydrate, betulin, borneol, isoborneol, adamantanol, norborneol, fenchol, camphor, and 1,2;5,6-diisopropylidene-D-mannitol.

As the de-coloring agent, among the above-mentioned compounds, a basic compound, particularly a hindered amine derivative is preferably used because it has high de-coloring speed and high de-coloring property.

As the process for producing the de-coloring particles, the same production process as that for the colored particles can be used, and the de-coloring particles are formed along with an additional component such as a release agent into fine particles having a size on the order of microns in a range from 3 to 20 μm. However, it is more preferred that the particles are finely pulverized by wet-pulverization etc. so as to reduce the particle diameter to the order of sub-microns in a range from 10 to 1000 nm, particularly from 50 to 500 nm because the de-coloring action is uniformly and promptly exhibited.

The proportion of the de-coloring particles to the colored particles is from 0.01% to 50%, desirably from 0.1 to 30%. If it is less than 0.01%, the de-coloring property deteriorates and the toner is left colored after an erasing operation. On the other hand, if it exceeds 50%, the chargeability of the toner deteriorates and toner scattering or fogging occurs. For the same reason, the de-coloring agent in the de-coloring particles is used in an amount of preferably from 0.1 to 50 parts, particularly preferably from 0.5 to 10 parts, per one part of the color developer agent in the colored particles.

Examples of a production device for the colored particles and the de-coloring particles of the invention include the following devices.

A kneader is not particularly limited as long as it can melt-knead materials, and examples thereof include single-screw extruders, twin-screw extruders, pressure kneaders, Banbury mixers, and Brabender mixers. Specific examples thereof include: FCM (manufactured by Kobe Steel, Ltd.), NCM (manufactured by Kobe Steel, Ltd.), LCM (manufactured by Kobe Steel, Ltd.), ACM (manufactured by Kobe Steel, Ltd.), KTX (manufactured by Kobe Steel, Ltd.), GT (manufactured by Ikegai, Ltd.), PCM (manufactured by Ikegai, Ltd.), TEX (manufactured by the Japan Steel Works, Ltd.), TEM (manufactured by Toshiba Machine Co., Ltd.), ZSK (manufactured by Warner K.K.), and KNEADEX (manufactured by Mitsui Mining Co., Ltd.).

Examples of a dry pulverize include: ball mills, atomizers, Bantam mills, pulverizers, hammer mills, roll crushers, cutter mills, and jet mills.

A wet pulverizer is not particularly limited as long as it can grind materials in a wet state, and examples thereof include high-pressure pulverizers such as Nanomizer (manufactured by Yoshida Kikai Co., Ltd.), Altimizer (manufactured by Sugino Machine, Ltd.), NANO 3000 (manufactured by Beryu Co., Ltd.), Microfluidizer (manufactured by Mizuho Industrial Co., Ltd.), and Homogenizer (manufactured by Izumi Food Machinery Co., Ltd.); rotor stator stirrers such as Ultra Turrax (manufactured by IRA Japan K.K.), T.K. Auto Homo Mixer (manufactured by Primix Corporation), T.K. Pipeline Homo Mixer (manufactured by Primix Corporation), T.K. Filmics (manufactured by Primix Corporation), Clear mix (manufactured by M-Technique Co., Ltd.), Clear SS5 (manufactured by M-Technique Co., Ltd.), Cavitron (manufactured by Eurotec, Ltd.), and Fine Flow Mill (manufactured by Pacific Machinery & Engineering Co., Ltd.); and medium-type stirrers such as Visco mill (manufactured by Aimex Co., Ltd.), Apex mill (manufactured by Kotobuki Industries Co., Ltd.), Star Mill (manufactured by Ashizawa Finetech, Ltd.), DCP Super flow (manufactured by Nippon Eirich Co., Ltd.), MP Mill (manufactured by Inoue Manufacturing Co., Ltd.), Spike Mill (manufactured by Inoue Manufacturing Co., Ltd.), Mighty Mill (manufactured by Inoue Manufacturing Co., Ltd.), and SC Mill (manufactured by Mitsui Mining Co., Ltd.).

Examples of a dry mixer include Henschel Mixer (manufactured by Mitsui Mining Co., Ltd.), Super Mixer (manufactured by Kawata MFG Co., Ltd.), Ribocone (manufactured by Okawara Corporation), Nauta Mixer (manufactured by Hosokawa Micron Corporation), Turbulizer (manufactured by Hosokawa Micron Corporation), Cyclomix (manufactured by Hosokawa Micron Corporation), Spiralpin Mixer (manufactured by Pacific Machinery & Engineering Co., Ltd.), and Lodige Mixer (manufactured by Matsubo Corporation).

As a drying device, for example, a vacuum dryer, an air flow dryer, a fluidized dryer, a spray dryer, etc. is preferably used.

Figure 2:
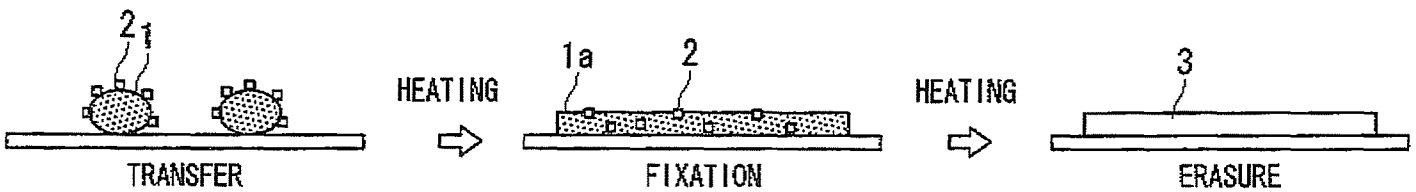
FIG. 2 is a schematic view illustrating color developing and erasing processes using a toner containing de-coloring particles with a size on the order of sub-microns.

By mixing the colored particles and the de-coloring particles obtained as described above at a predetermined ratio described above, a toner (particle mixture) is obtained. The obtained toner undergoes a process of transfer (colored)—fixation (colored)—color erasure (colorless) as shown in FIG. 1 or 2 depending on the particle diameter of the de-coloring particles. FIG. 1 shows a case where the de-coloring particles have a size on the order of microns, and colored particles 1 and de-coloring particles 2 are separately transferred and an image in a color developed state (colored film) 1*a* is formed due to a reaction between the color former compound and the color developer agent by melting the colored particles 1 at a fixing temperature. When the colored image after use is heated to a color erasing temperature exceeding the fixing temperature as needed, the de-coloring particles 2 are melted, thereby causing a reaction between the de-coloring agent and the color developer agent in the colored particles 1, and then, the color former compound is released in an achromatic state to leave a colorless fixed film 3, whereby the color of the colored image is erased. FIG. 2 shows a case where the de-coloring particles having a size on the order of sub-microns are used, and the de-coloring particles 2 are transferred in a close contact state where the de-coloring particles 2 attached to the surfaces of the colored particles 1, and when the color is erased, the de-coloring agent uniformly and promptly acts on a colored image 1*a* after fixation to exhibit a uniform and prompt decoloring action, whereby a colorless fixed image is formed.

EXAMPLES

Hereinafter, preparation and evaluation of toners will be described with reference to Examples and Comparative Examples.

<Preparation of Colored Particles>

Crystal Violet Lactone (abbreviated as CVL): 5%
Bisphenol A: 10%
Styrene-butadiene resin: 80%
Polypropylene wax: 5%

A mixture containing the above components at the above proportions was melt-kneaded using a twin-screw kneader and then processed using a jet mill, whereby particles having a size of 10 μm were obtained. To the obtained particles, 1% silica and 0.5% titanium oxide were added, for external addition, using a Henschel mixer, whereby colored particles having a particle diameter (a 50%-volume average particle diameter as measured by "Multisizer 3", made by Beckman Coulter, Inc.; the same as below) of 10 μm were obtained.

<Preparation of De-Coloring Particles A>

ADECABTAB LA-57 (tetrakis(2,2,6,6-tetramethyl-4-piperidyl)-butane-1,2,3,4-butanetetracarboxylate which is a hindered amine-based de-coloring agent and has a melting point (Tmp) of 125° C.); manufactured by Adeca Corporation) was pulverized to 5 μm using a jet mill. To the obtained particles, 1% silica and 0.5% titanium oxide were added, for external addition, using a Henschel mixer, whereby De-coloring particles A having a particle diameter of 5 μm were obtained.

<Preparation of De-Coloring Particles B>

Tetrakis(2,2,6,6-tetramethyl-4-piperidyl)-butane-1,2,3,4-butanetetracarboxylate (Tmp: 125° C.): 30%

Nonionic surfactant (Emulgen 1118S-70); 5%

De-ionized water: 65%

The above components were mixed and pulverized to a particle diameter of 0.8 μm using a bead mill. Then, the resulting particles were dried using a spray dryer, whereby De-coloring particles B were obtained.

<Preparation of De-Coloring Particles C>

ADECASTAB LA-52 (tetrakis(1, 2, 2, 6,6-pentamethyl-4-piperidyl)-1,2,3,4-butanetetracarboxylate, Tmp: 65° C., manufactured by Adeca Corporation): 30%

Polypropylene wax (Tmp: 145° C.): 70%

The above components were melt-kneaded using a pressure kneader and pulverized to 5 μm using a jet mill. To the obtained particles, 1% silica and 0.5% titanium oxide were added, for external addition, using a Henschel mixer, whereby De-coloring particles C having a particle diameter of 5 μm were obtained.

<Preparation of De-Coloring Particles D>

Color erasing particles C: 30%

Nonionic surfactant (Emulgen 11182-70): 5%

De-ionized water: 65%

The above components were mixed and pulverized to a particle diameter of 0.8 m using a bead mill. Then, the resulting particles were dried using a spray dryer, whereby De-coloring particles D were obtained.

Example 1

To the colored particles obtained above, De-coloring particles A were added in an amount of 5% based on the amount of the colored particles and mixed therewith using a Henschel mixer, whereby a toner was obtained.

The obtained toner was placed in a modified multifunctional electrophotographic machine ("e-STUDIO 281c" manufactured by Toshiba Tec Corporation and modified so as to obtain an unfixed image for evaluation), and an unfixed image was outputted on paper having an density (ID, as measured by a reflection densitometer "Macbeth RD-191", the same as herein) of 0.05. Then, the unfixed image was fixed using an external fixing device set to 110° C., whereby a fixed image in a color developed state having an ID of 0.6 was obtained. Thereafter, the fixed image was placed on a hotplate set to 180° C., whereby the image could be erased (de-colored) in 10 seconds. The ID after the erasure was 0.1.

Example 2

To the colored particles, De-coloring particles B were added in an amount of 5% and mixed therewith using a Henschel mixer, for external addition, whereby a toner was obtained.

The obtained toner was placed in the same modified multifunctional electrophotographic machine as used in Example 1, and an unfixed image was outputted on paper having an ID of 0.05. Then, the unfixed image was fixed using an external fixing device set to 110° C., whereby a fixed image in a color developed state having an ID of 0.6 was obtained. Thereafter, the fixed image was placed on a hot plate set to 180° C., whereby the image could be erased in 3 seconds. The ID after the erasure was 0.1.

Example 3

To the colored particles, De-coloring particles C were added in an amount of 20% and mixed therewith using a Henschel mixer, for external addition, whereby a toner was obtained.

The obtained toner was placed in the same modified multifunction peripheral as used in Example 1, and an unfixed image was outputted on paper having an ID of 0.05. Then, the unfixed image was fixed using an external fixing device set to 110° C., whereby a fixed image in a color developed state having an ID of 0.6 was obtained. Thereafter, the fixed image was placed on a hot plate set to 180° C., whereby the image could be erased in 10 seconds. The ID after the erasure was 0.1.

Example 4

To the colored particles, De-coloring particles D were added in an amount of 20% and mixed therewith using a Henschel mixer, for external addition, whereby a toner was obtained.

The obtained toner was placed in the same modified multifunction peripheral as used in Example 1, and an unfixed image was outputted on paper having an ID of 0.05. Then, the unfixed image was fixed using an external fixing device set to 110° C., whereby a fixed image in a color developed state having an ID of 0.6 was obtained. Thereafter, the fixed image was placed on a hot plate set to 180° C., whereby the image could be erased in 5 seconds. The ID after the erasure was 0.1.

Comparative Example 1

CVL: 5%

Bisphenol A: 10%

ADECASTAB LA-57 (tetrakis(2,2,6,6-tetramethyl-4-piperidyl)-butane-1,2,3,4-butanetetracarboxylate; the same as used in preparation of De-coloring particles A) 5%

Styrene-butadiene resin: 70%

Polypropylene wax: 5%

The above components were melt-kneaded using a twin-screw kneader and then pulverized using a jet mill. To the obtained particles, 1% silica and 0.5% titanium oxide were added, for external addition, using a Henschel mixer, whereby toner particles having a size of 10 μm in a slightly colored state were obtained. The obtained toner was placed in the same modified multifunctional electrophotographic machine as used in Example 1, and an unfixed image was outputted on paper having an ID of 0.05. Then, the unfixed image was fixed using an external fixing device set to 110° C., whereby an image having an ID of 0.15 and very poor visibility was obtained.

Comparative Example 2

CVL: 5%

Bisphenol A: 10%

Cholic acid: 10%

Styrene-butadiene resin: 70%

Polypropylene wax: 5%

The above components were melt-kneaded using a twin-screw kneader and then pulverized using a jet mill. To the obtained particles, 1% silica and 0.5% titanium oxide were added, followed by an external addition treatment using a Henschel mixer, whereby toner particles having a size of 10 μm in a color developed state were obtained. The obtained toner was placed in the same modified multifunctional electrophotographic machine as used in Example 1, and an unfixed image was outputted on paper having an ID of 0.05. Then, the unfixed image was fixed using an external fixing device set to 110° C., whereby a fixed image in a color developed state having an ID of 0.6 was obtained. Thereafter, the fixed image was placed on a hot plate set to 180° C., whereby it took 1 hour to decrease the ID to 0.1.

As is clear from the above-mentioned Examples and Comparative Examples, according to the invention, there is obtained an erasable toner having excellent color developing and erasing properties, by assigning color developing erasing functions, required of a toner of a color developing-erasing system containing a color former compound, a color developer agent and a de-coloring agent, to two separate types of particles, i.e., colored particles containing at least a color former compound, a color developer agent and a binder resin, and de-coloring particles having a melting point higher than the fixing temperature of the colored particles, so that the color developing erasing functions are well separated from each other.

What is claimed is:

1. An erasable toner, comprising:

a particle mixture of colored particles containing at least a color former compound, a color developer agent and a binder resin, and de-coloring particles; wherein the de-coloring particles consist essentially of a de-coloring agent and have a melting point substantially the same as that of the de-coloring agent.

2. The toner according to claim 1, wherein the de-coloring particles have a size on the order of microns and form the particle mixture with the colored particles having a size on the order of microns.

3. The toner according to claim 1, wherein the de-coloring particles have a size on the order of sub-microns and is present in a state being attached to surfaces of the colored particles having a size on the order of microns.

4. The toner according to claim 1, wherein the de-coloring agent is basic.

5. The toner according to claim 4, wherein the de-coloring agent is a hindered amine derivative.

* * * * *